US005758320A

United States Patent [19]

Asano

[11] Patent Number: 5,758,320

[45] Date of Patent: May 26, 1998

[54] METHOD AND APPARATUS FOR TEXT-TO-VOICE AUDIO OUTPUT WITH ACCENT CONTROL AND IMPROVED PHRASE CONTROL

[75] Inventor: Yasuharu Asano, Kanagawa, Japan

[73] Assignee: Sony Corporation, Tokyo, Japan

[21] Appl. No.: 489,316

[22] Filed: Jun. 12, 1995

[30] Foreign Application Priority Data

Jun. 15, 1994 [JP] Japan ..... 6-158141

[51] Int. Cl.[6] ..... G10L 3/02

[52] U.S. Cl. ..... 704/258; 704/265; 704/268; 704/269

[58] Field of Search ..... 395/2.09, 2.1, 395/2.14, 2.16, 2.67, 2.69, 2.76, 2.77; 704/200, 201, 205, 207, 258, 260, 267, 268

[56] References Cited

U.S. PATENT DOCUMENTS

| | | | |
|---|---|---|---|
| 3,704,345 | 11/1972 | Coker et al. | 704/266 |
| 4,695,962 | 9/1987 | Goudie | 704/267 |
| 4,797,930 | 1/1989 | Goudie | 704/268 |
| 4,907,279 | 3/1990 | Higuchi et al. | 704/260 |
| 5,463,713 | 10/1995 | Hasegawa | 704/260 |
| 5,475,796 | 12/1995 | Iwata | 704/260 |
| 5,572,625 | 11/1996 | Raman et al. | 704/260 |

*Primary Examiner*—David R. Hudspeth
*Assistant Examiner*—Michael N. Opsasnick
*Attorney, Agent, or Firm*—Jay H. Maioli

[57] ABSTRACT

A text-to-voice audio output unit includes a storage section for storing analyzed information pertaining to words, boundaries between articulations, and accents obtained by analyzing an input character list, a voice synthesis rule section for changing a reduction or damping characteristic of a phrase component of a fundamental frequency of an output voice, and a voice synthesizing section for generating a composite tone based on the analyzed information from the storage section. The reduction or damping characteristic, calculated for each phrase component, is overdamped, critically damped, or underdamped and is based on speech rate, syntactic information, number of articulations, and positional information. When a prosodic phrase is short, the reduction or damping characteristic causes a decrease in the fundamental frequency for a meaningfully-delimited portion, and when a prosodic phrase is long, the reduction or damping characteristic is controlled over the entire prosodic phrase.

4 Claims, 5 Drawing Sheets

SPEECH RATE 8 [MORA/SEC]

SYNTACTIC INFORMATION "shizen no kenkyusha wa": SUBJECTIVE PART

"shizen wo nejifuseyou to shite wa ikenai": PREDICATIVE PART

↑shi`zen no´ke`nkyu´usha wa↑
shi`zen wo´ne`jifuse´you to shite wai`kenai´↓
↑, ↓ : PHRASE COMMAND
`, ´ : ACCENT COMMAND

FIG. 6

| | |
|---|---|
| NUMBER OF MORAS | BETWEEN PHRASE COMMANDS 1 AND 2: 10 MORAS |
| | BETWEEN PHRASE COMMANDS 2 AND 3: 18 MORAS |
| POSITIONAL INFORMATION | PHRASE COMMAND 1: 0TH MORA FROM HEAD |
| | PHRESE COMMAND 2: 10TH MORA FROM HEAD |
| | PHRASE COMMAND 3: 28TH MORA FROM HEAD |
| | ACCENT COMMAND 1: 1ST TO 4TH MORA FROM HEAD |
| | ACCENT COMMAND 2: 5TH TO 7TH MORA FROM HEAD |
| | ACCENT COMMAND 3: 11TH TO 14TH MORA FROM HEAD |
| | ACCENT COMMAND 4: 15TH TO 18TH MORA FROM HEAD |
| | ACCENT COMMAND 5: 25TH TO 28TH MORA FROM HEAD |

FIG. 7

METHOD AND APPARATUS FOR TEXT-TO-VOICE AUDIO OUTPUT WITH ACCENT CONTROL AND IMPROVED PHRASE CONTROL

BACKGROUND OF THE INVENTION

1. Field of the Invention

The present invention relates to an audio output unit and method thereof, and more particularly, to an audio output unit in accordance with a rule synthesis method.

2. Description of the Related Art

Generally, the voice is roughly divided into an articulatory feature mainly expressed by a spectral envelope and a prosodic feature mainly expressed by a temporal pattern of a fundamental frequency (hereinafter referred to as a fundamental frequency pattern). The articulatory feature is a local feature, which can be synthesized by an analysis-by-synthesis method of storing and connecting acoustic features by a small unit such as a syllable. On the contrary, the prosodic feature is a feature ranging over the whole sentence and therefore, synthesis according to a rule is advisable because the prosodic feature is diversely converted by a word constitution or sentence pattern.

The prosodic feature is mainly expressed by parameters such as a fundamental frequency and an intensity of a vocal-cord sound source, and duration of a phoneme. The fundamental frequency of the vocal-cord sound source as a main acoustic expression of the prosodic feature covers linguistic information such as a word accent, emphasis, intonation, and syntax, and simultaneously it provides non-language information such as emotion including speaker's personality and speech in the process in which the above pieces of information are realized through an individual vocal-cord vibration system. However, in view of synthesis according to a rule, it is most important to quantitatively express the process for converting linguistic information into a temporal change of a fundamental frequency.

Therefore, it is necessary for the above synthesis according to a rule to describe the essential relation between an input symbol string and a temporal change pattern of the above parameters in accordance with a brief and precise rule. However, because symbols necessary for the synthesis of the prosodic feature are not specified in a text, it is necessary to derive them by using linguistic information such as accent type of a word, word-unifying structure of a sentence, and conversational structure of a text. Moreover, a model for relating the prosodic feature with corresponding symbols is necessary for voice synthesis because the prosodic feature is continuous but the corresponding symbols are discrete.

In the prosodic information, intonation and accent are particularly important to upgrade the quality of composite tone. Though a pitch (fundamental frequency), intensity, and length of voice relate to the quality of composite tone, a fundamental frequency is a factor directly controlling other factors. FIG. 1 shows an example of a method for expressing a fundamental-frequency pattern of sentence speech. This is expressed by superimposing the phrase component corresponding to the intonation of the whole sentence and the accent component which is a pattern peculiar to individual words and syllables (Furui, "Digital Speech Processing", ToKai University, 1985).

An example of using a response of a secondary linear system when generating the fundamental-frequency pattern by an audio output unit, is a fundamental-frequency pattern generation model (Hirose, Fujizaki, Kawai, and Yamaguchi, "Synthesis of text speech according to fundamental-frequency pattern generation process model", DENSHI-JOHO TSUSHIN GAKKAI RONBUNSHI (transliterated), Vol. J72-A No. 1, 1989), which is generally used to control a fundamental-frequency pattern. The generation method uses a response of a critical-damping secondary linear system of an impulsive command (phrase command) corresponding to a phrase component (intonation component), and a response of a critical-damping secondary linear system of a step command (accent command) corresponding to an accent component as a model for generating a fundamental-frequency pattern, and further uses these responses superimposed onto each other to produce a fundamental-frequency temporal pattern.

In this case, when assuming a fundamental frequency as $F_O$, the fundamental frequency can be shown as a function of time "t" by the following equation:

$$\ln F_0(t) = \ln F_{min} + \sum_{i=1}^{1} A_{pi} G_{pi}(t - T_{0i}) + \sum_{j=1}^{1} A_{aj}\{G_{aj}(t - T_{1i}) - G_{aj}(t - T_{2i})\} \quad (1)$$

Here, $G_{pi}(t)$ represents an impulse response function of a phrase control system, $G_{aj}(t)$ represents a step response function of an accent control system. Moreover, $A_{pi}$ represents the size of a phrase command, $A_{aj}$ represents the size of an accent command, $T_{Oi}$ represents the point of time of a phrase command, and $T_{1j}$ and $T_{2j}$ represent the start and end points of the accent command.

However, because the above generation method using a secondary linear system as a response model is used by limiting a response to a response for critical damping, the reduction rate of the phrase component is constant. Therefore, when a prosodic phrase (a phrase between two phrase commands that is delimited by a phrase command and the next phrase command and meaningfully arranged) is short, the phrase component does not decrease completely. Moreover, when the prosodic phrase is long, the phrase component barely changes at the end of the prosodic phrase. Therefore, it is problematic that fundamental frequency only slightly changes and a meaningful delimitation is unclear.

SUMMARY OF THE INVENTION

In view of the foregoing, an object of this invention is to provide an audio output unit which can generate composite tone which is natural and understandable as a whole.

The foregoing object and other objects of the invention have been achieved by the provision of an audio output unit (1) for expressing a temporal change pattern of the fundamental frequency of voice which covers linguistic information such as a basic accent, emphasis, intonation, and syntax by the sum of a phrase component corresponding to the intonation and an accent component corresponding to the basic accent, approximating the phrase component by a response of a secondary linear system to an impulsive phrase command and the accent component by a response of a secondary linear system to a step accent command, and expressing the temporal change pattern of the fundamental frequency on a logarithmic axis, comprising: an analyzed information storage section (3) for storing a word, a boundary between articulations, and a basic accent obtained by analyzing an input character list; a voice synthesis rule section (4) for changing the reduction characteristic of the phrase component of the fundamental frequency, thereby controlling the response characteristic of the secondary linear system to the phrase component in order to calculate the phrase component, and generating the temporal change pattern of the fundamental frequency in accordance with the phrase component; and a voice synthesizing section (6) for generating a composite tone by synthesized waveform data generated in accordance with a predetermined phonemic rule and the temporal change pattern of the fundamental frequency based on the analyzed information of the analyzed information storage section.

A fundamental frequency can greatly be reduced at a meaningful boundary of voice contents and a voice strictly reflecting a syntax structure can be outputted by changing the reduction characteristic of the phrase component of the fundamental frequency thereby controlling the response characteristic of a secondary linear system to the phrase component in order to calculate the phrase component,so that it is possible to easily generate a natural and understandable composite tone as a whole.

The nature, principle and utility of the invention will become more apparent from the following detailed description when read in conjunction with the accompanying drawings in which like parts are designated by like reference numerals or characters.

BRIEF DESCRIPTION OF THE DRAWINGS

In the accompanying drawings:

FIG. 6 is a schematic diagram showing an example of a phrase command and an accent command obtained from a phrase command generation section and an accent command generation section of a voice synthesis rule section; and FIG. 7 is a schematic diagram showing an example of the number of moras and positional information for phrase and accent commands obtained from a mora number and positional information extracting section of a voice synthesis rule section.

DETAILED DESCRIPTION OF THE EMBODIMENT

Figure 1:
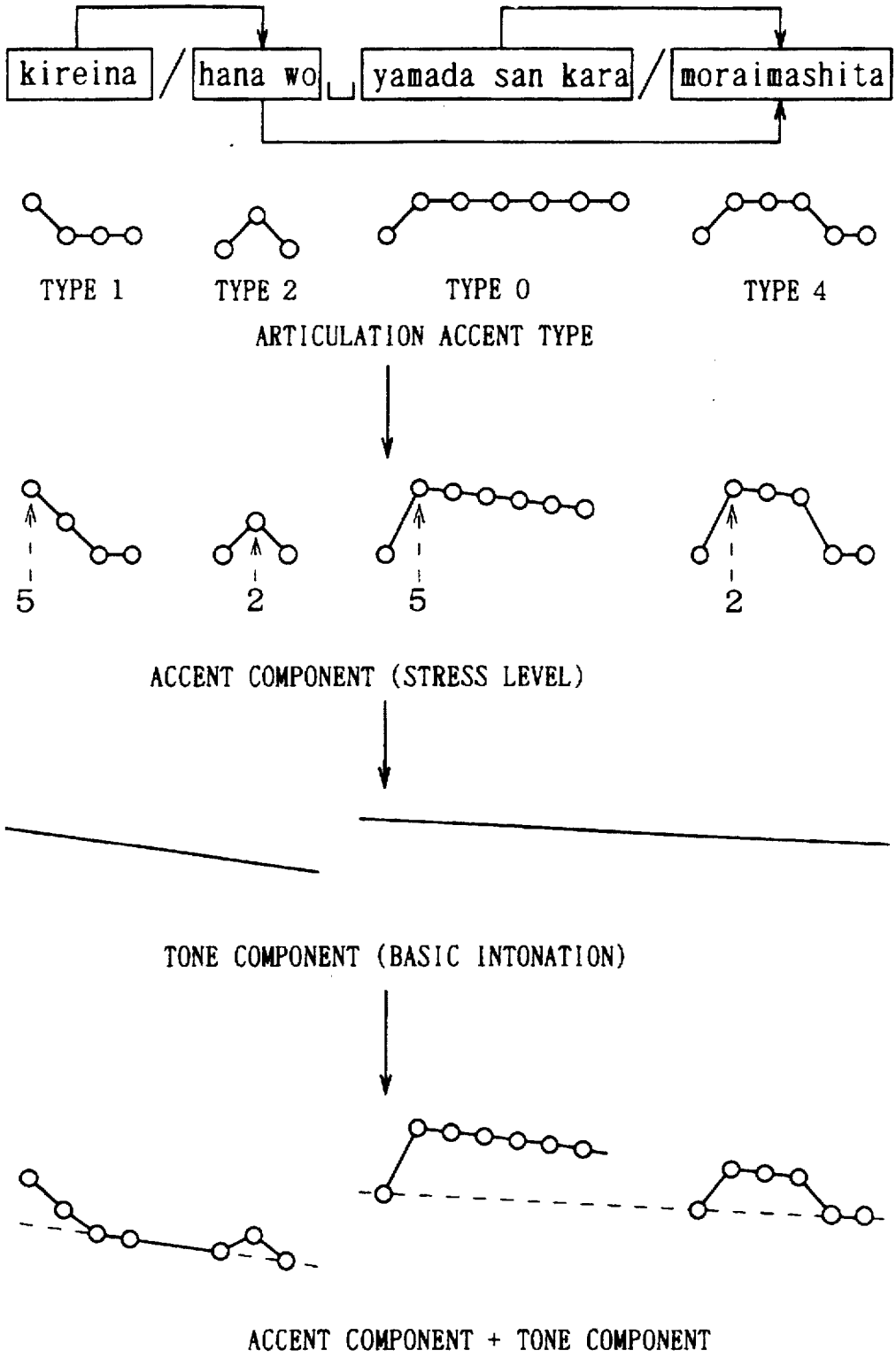
FIG. 1 is a schematic diagram showing a method for expressing a fundamental frequency pattern.
Figure 2:
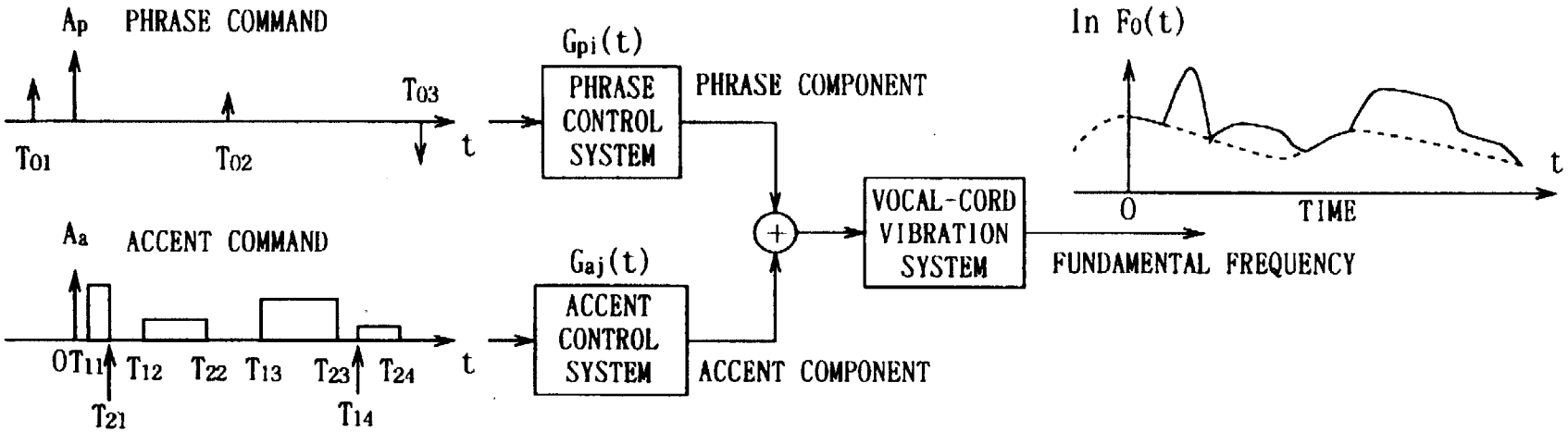
FIG. 2 is a block diagram showing a model for a fundamental frequency pattern generation process.
Figures 3, 5:
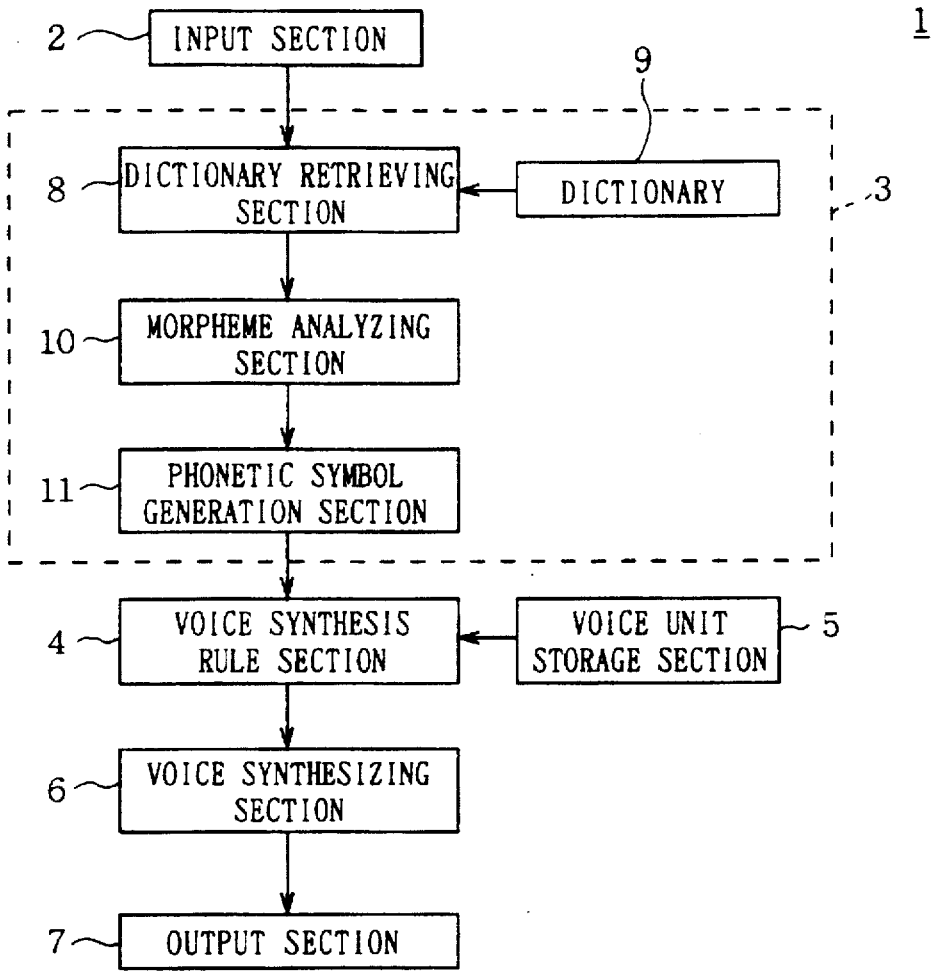
FIG. 3 is a block diagram showing the schematic constitution and the processing flow of the Japanese text audio output unit according to an embodiment of the present invention.
FIG. 5 is a schematic diagram showing a speech rate and syntactic information obtained from a speech rate and syntactic information extracting section of a voice synthesis rule section.

Preferred embodiments of the present invention will be described with reference to the accompanying drawings:

In FIG. 3, 1 represents a schematic constitution and a processing flow of a Japanese-text audio output unit as a whole, which is constituted so that a natural and understandable composite tone is generated as a whole by changing the reduction characteristic of a phrase component, thereby controlling a response of a secondary linear system to the phrase component at the levels of overdamping, critical damping, and underdamping in order to calculate the phrase component, and generating a fundamental frequency pattern in accordance with the phrase component.

As shown in FIG. 3, the audio output unit 1 is composed of an input section 2 (including, for example, a keyboard, an OCR (optical character reader), and a magnetic disc) for inputting a kanji-kana mixed sentence (text), a text analyzing section 3, a voice synthesis rule section 4, a voice unit storage section 5 (e.g., a storage unit such as an IC memory or magnetic disc), a voice synthesizing section 6, and an output section 7.

The text analyzing section 3 retrieves words included in a kanji-kana mixed sentence inputted from the input section 2 by a dictionary 9 (e.g., a storage unit such as an IC memory or magnetic disc) storing the spelling of a word serving as the criterion of a morpheme (word) and its auxiliary information (e.g., reading, part of speech, and accent) in a dictionary retrieving section 8, thereafter analyzes the words into morphemes by a morpheme analyzing section 10 in accordance with the kanji-kana mixed sentence and a word group retrieved by the dictionary retrieving section 8, and generates a phonetic symbol string by a phonetic symbol generation section 11 in accordance with data sent from the morpheme analyzing section 10.

That is, the text analyzing section 3 analyzes a kanji-kana mixed sentence inputted from the input section 2 in accordance with the predetermined dictionary 9 to convert the sentence into a kana character string, and thereafter breaks the sentence into words and articulations. In this case, because Japanese words are not written in a segmented style, unlike English, the word "beikokusangyokai", for example, can be divided into two types such as "beikoku/sangyo-kai" and "bei/kokusan/gyokai". Therefore, the text analyzing section 3 breaks a kanji-kana mixed sentence into words and articulations by using the continuous relation of speech and the statistical property of words while referring to the dictionary 9, and thereby distinguishes between words and articulations. Moreover, the text analyzing section 3 detects a basic accent for each word and then outputs their basic accents to the voice synthesis rule section 4.

Figure 4:
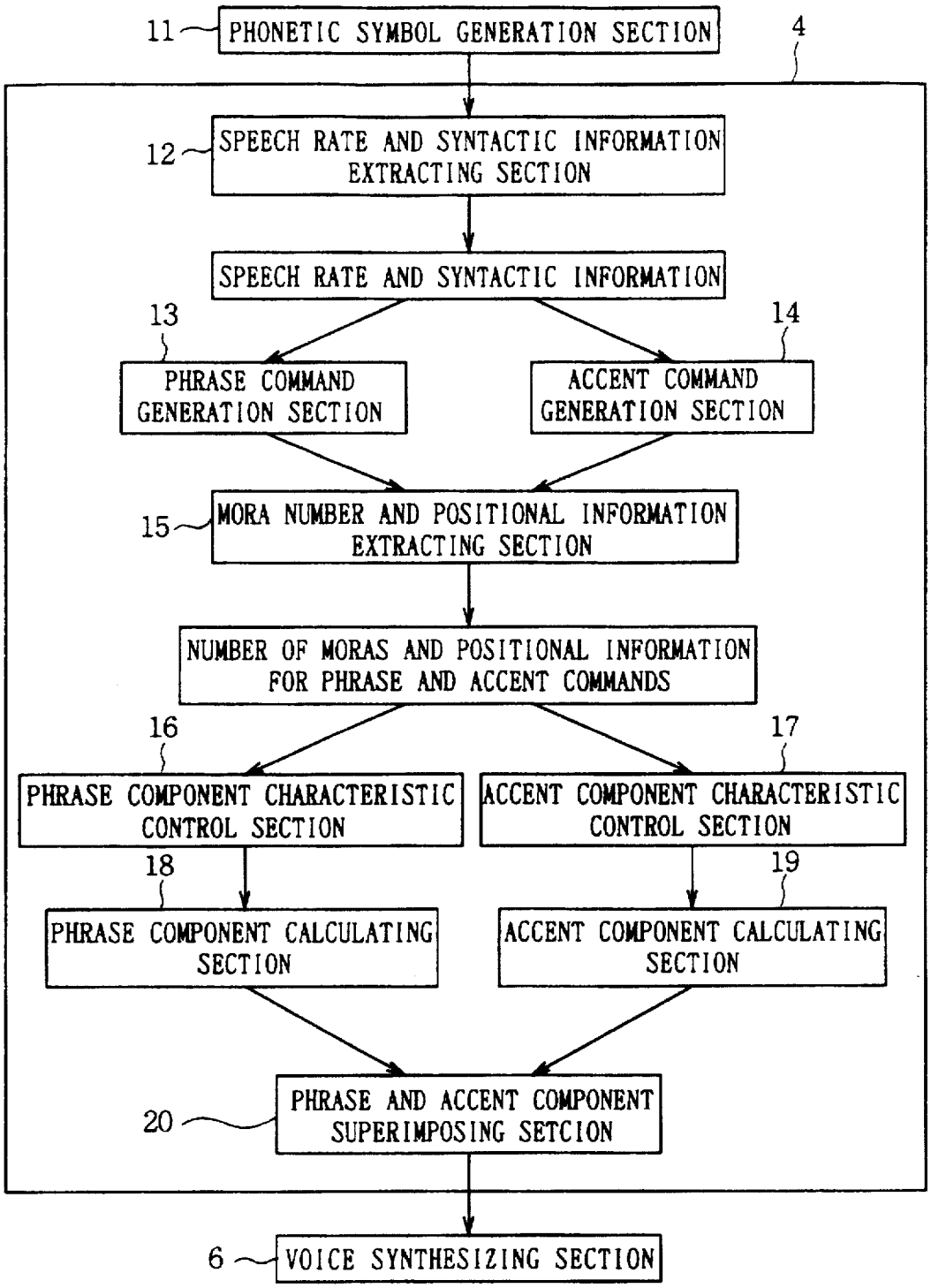
FIG. 4 is a block diagram showing the constitution of the voice synthesis rule section and the processing flow of the Japanese text audio output unit according to an embodiment of the present invention.

As shown in FIG. 4, the voice synthesis rule section 4 is composed of a speech rate and syntactic information extracting section 12, a phrase command generation section 13, an accent command generation section 14, a mora number and positional information extracting section 15, a phrase component characteristic control section 16, an accent component characteristic control section 17, a phrase component calculating section 18, an accent component calculating section 19, and a phrase and accent components superimposing section 20 so as to obtain synthesized waveform pattern and fundamental frequency pattern of voice out of the data obtained from the phonetic symbol generation section 11, the information loaded from the voice unit storage section 5, and the predetermined phonemic and prosodic rules set to the voice synthesis rule section 4.

The speech rate and syntactic information extracting section 12 extracts the information related to a speech rate and the syntactic information out of the information inputted from the phonetic symbol generation section 11. Then, the phrase command generation section 13 generates a position and size of a phrase command for controlling a phrase component in accordance with the extracted speech rate and syntactic information, and the accent command generation section 14 generates a position and size of an accent command for controlling an accent component. Then, the mora number and positional information extracting section 15 obtains the number of moras and the positional information for the phrase and accent commands for the period of recovering the phrase component (that is, for the period in which the component comes to zero and then rises again) out of the positional information for the phrase command and that for the accent command.

In accordance with the four pieces of information obtained by the above processing such as speech rate, syntactic information, number of moras, and positional information for phrase and accent commands, the phrase component characteristic control section 16 controls the reduction characteristic of the phrase component, and the accent component characteristic control section 17 controls the shape of the accent component. In accordance with the control results, the phrase component calculating section 18 calculates the phrase component and the accent component calculating section 19 calculates the accent component.

In the case of the embodiment of the present invention, a model for approximating an impulse response of a secondary linear system is used for the calculation of a phrase component by the phrase component calculating section 18, and the phrase component characteristic control section 16 is constituted so as to control a damping factor together with the point of time and the value of a phrase command necessary for calculating the phrase component. When assuming the damping factor (value of the reduction characteristic of a phrase component) of a secondary linear system used for a phrase component calculation model as $\delta$, the damping factor $\delta$ can be represented in the form of a function by the following expression:

$$\delta = f(a, b, c, d) \quad (2)$$

Here, "a" represents a variable showing the speech rate of voice to be output, "b" represents a variable showing the number of articulations (number of moras) for the period of recovering a phrase component, "c" represents a variable showing the syntactic information of voice to be output, and "d" represents a variable showing the positional information for a phrase component in a sentence and a text to be output. A concrete factor of the function "f" can be calculated in accordance with previously prepared voice data by using the statistical technique and the case sorting technique.

The damping factor $\delta$ is determined for each phrase command used to calculate a phrase component by using the function "f" thus expressed, and each component is calculated by the phrase component calculation section 18 in accordance with the above result. Thereby, it is possible to calculate a fundamental frequency pattern for outputting accurate and understandable voice. Lastly, the phrase and accent component superimposing section 20 generates a fundamental frequency pattern by superimposing the phrase component calculated by the phrase component calculating section 18 with the accent component calculated by the accent component calculating section 19.

The voice synthesis rule section 4 is constituted so as to process a detection result by the text analyzing section 3 and an input text in accordance with a predetermined phonemic rule set based on the feature of Japanese language. That is, the input text is converted into a voice unit symbol string in accordance with the phonemic rule. Moreover, the voice synthesis rule section 4 loads data for each phoneme from the voice unit storage section 5 in accordance with the phonemic symbol string.

In the audio output unit 1, the data loaded from the voice unit storage section 5 comprises waveform data used to generate composite tone expressed by each CV (consonant and vowel). The voice unit data used for the waveform synthesis has the following constitution. In the voiced part of the voice unit data, both impulse and unit response corresponding to one pitch extracted by the complex cepstrum analysis technique are combined as one unit, and combinations equivalent to the number of frames necessary for the voiced part of voice unit are stored as the data for the voiced part. In the unvoiced part of voice unit, the unvoiced part of actual voice is directly extracted and stored as data.

Therefore, when the voice unit data comprises a CV unit, one piece of voice unit data is constituted with a plurality of sets of an unvoiced extracted waveform, an impulse, and a unit response waveform if the consonant part C of one voice unit CV is an unvoiced consonant. Moreover, if the consonant part C of one voice unit CV is a voiced consonant, one piece of voice unit data is constituted only with a plurality of sets of an impulse and a unit response waveform.

The complex cepstrum analysis is an already known high-quality pitch conversion method or speech rate conversion method in the analysis-by-synthesis method for actual voice and a useful analysis technique in the analysis-by-synthesis method for voice is used for rule synthesis of any sentence speech. The voice synthesis rule section 4 loads the voice unit data thus constituted from the voice unit storage section 5, synthesizes the data in a sequence corresponding to an input text. Thus, it is possible to obtain a composite tone waveform in a state where an input text is read out free from intonation.

Then, the voice synthesizing section 6 generates a composite tone by performing waveform synthesis processing in accordance with synthesized waveform pattern and fundamental frequency pattern of voice. In the waveform synthesis processing, the following processes are performed. Impulses in synthesized waveform data are arranged in accordance with the fundamental frequency pattern in the voiced part and a unit response waveform corresponding to each of the arranged impulses is superimposed on each impulse.

Moreover, in the unvoiced part of a composite tone, an extracted waveform in the synthesized waveform data is directly used as the waveform of a desired composite tone. Thereby, it is possible to obtain a composite tone in which intonation changes by following the conversion of the fundamental frequency pattern. Therefore, since impulses are used for sound source information in the composite tone, the sound source information is barely influenced by a change of the pitch cycle of the composite tone. Moreover, even if the fundamental frequency pattern greatly changes, no distortion is generated on a spectral envelope and a high-quality optional composite tone close to human voice is obtained. The composite tone obtained by the waveform synthesis is output from the output section 7 (e.g., speaker or magnetic disc).

In the above embodiment, when, for example, a text "shizen no kenkyuusha wa shizen wo nejifuseyou to shitewa ikenai" is input to the Japanese text audio output unit 1, the input text is analyzed by the text analyzing section 3 in accordance with the dictionary 8, and boundaries between words and articulations and basic accents are detected to generate a phonetic symbol string.

Then, the speech rate and syntactic information extracting section 12 of the voice synthesis rule section 4 extracts the speech rate and syntactic information shown in FIG. 5 out of the information input from the phonetic symbol generation section 11. That is, the information of 8 [mora/sec] is extracted as a speech rate, and the subjective part "shizen no kenkyuusha wa" and the predicative part "shizen wo nejifuseyou to shite wa ikenai" are extracted as syntactic information. Then, the phrase command generation section 13 and the accent command generation section 14 determine the position and size of a phrase command and an accent command in accordance with these pieces of information as shown in FIG. 6.

In the above example, the position and size of a phrase and an accent are designated as follows: "↑shizen noke nkyuusha wa↑ shizen wonejifuseyou to shitewa ikenai↓". In this case, symbols "↑" and "↓" respectively represent phrase commands, and symbols "" and "" respectively represent accent commands.

Then, the mora number and positional information extracting section 15 obtains the outputs shown in FIG. 7 from these pieces of information which represents that ten moras are set between phrase commands 1 and 2, and eighteen moras are set between phrase commands 2 and 3. Moreover, the positional information for phrase and accent commands represents that the phrase command 1 is set at the head of a text, e.g., the number of moras is zero, the phrase command 2 is set after the tenth mora from the head of the text, and the phrase command 3 is set after the twenty-eighth mora from the head of the text. In the same manner, it represents that the accent command 1 is set between the first and fourth moras from the head of the text, the accent command 2 is set between the fifth and seventh moras from the head of the text, the accent command 3 is set between the eleventh and fourteenth moras form the head of the text, the accent command 4 is set between the fifteenth and eighteenth moras from the head of the text, and the accent command 5 is set between the twenty-fifth and twenty-eighth moras from the head of the text.

Then, the phrase component characteristic control section 16 obtains the value value of the damping factor together with the point of time and the size of a phrase command in accordance with the previously obtained function "f" by using the above four pieces of information, that is, the speech rate, syntactic information, number of moras, and positional information for phrase command, and the phrase component calculating section 18 calculates a phrase component in accordance with the value of the damping factor. The calculated phrase component and the accent component calculated by the accent component characteristic control section 17 and the accent component calculating section 19 are added to each other by the phrase component and accent component superimposing section 20 to generate a desired fundamental frequency pattern. Moreover, the voice synthesis rule section 4 generates synthesized waveform data expressing voice obtained by reading out an input text in a state free from intonation. The synthesized waveform data is output to the voice synthesizing section 6 together with a fundamental frequency pattern, where a composite tone is generated in accordance with the synthesized waveform data and the fundamental frequency pattern, and then is output from the output section 7.

According to the embodiment described above, the reduction characteristic of the phrase component of the fundamental frequency is determined for each phrase command used when calculating the phrase component based on four pieces of information of speech rate, syntactic information, number of moras during recovery of the phrase component, so that it is possible to sufficiently decrease a fundamental frequency to a meaningfully-bordered portion when a prosodic phrase is short, and the reduction characteristic of a phrase component ranging over the whole prosodic phrase can be controlled when the prosodic phrase is long. Thus, a natural and understandable composite tone can be generated as a whole.

In the embodiment described above, the voice unit data is held by CV unit in the voice unit storage section 5. However, the present invention is not only limited to this, but the voice unit data can also be held by another the other voice unit data such as a CVC unit.

Although described above, the embodiment of is applied to the audio output unit 1, the present invention is not only limited to this, but can also be applied to such audio output units as a demodulator for efficient coding of an aural signal and a voice output unit, e.g., restoration unit for compressive transmission of voice. Therefore, it is possible to further accurately transmit the contents of a text to audio.

While the preferred embodiments of the invention have been described, it will be obvious to those skilled in the art that various changes and modifications may be encompassed, to cover in the appended claims all such changes and modifications as fall within the true spirit and scope of the invention.

What is claimed is:

1. An audio output unit for expressing a temporal change pattern of a fundamental frequency of an output voice using a sum of a phrase component corresponding to an intonation of the output voice and an accent component corresponding to a basic accent of the output voice, wherein the temporal change pattern of the fundamental frequency includes linguistic information such as basic accent, emphasis, intonation, and syntax, the phrase component is approximated by a response characteristic of a first secondary linear system to an impulsive phrase command, the accent component is approximated by a response characteristic of a second secondary linear system to a step accent command, and the temporal change pattern of the fundamental frequency is expressed on a logarithmic scale, the audio output unit comprising:

a storage section for storing analyzed information pertaining to an input character list, the analyzed information including a word, a boundary between articulations, and a basic accent;

a voice synthesis rule section including a phrase component characteristic control section for controlling a reduction or damping characteristic of a phrase component of a fundamental frequency in order to control a response characteristic of a first secondary linear system to a phrase command used in calculating the phrase component, the reduction or damping characteristic being any of an underdamped characteristic, a critically-damped characteristic, and an overdamped characteristic, and for generating a temporal change pattern of the fundamental frequency in accordance with the calculated phrase component; and a voice synthesizing section for generating a composite tone using synthesized waveform data generated in accordance with predetermined phonemic rules from the voice synthesis rule section and the temporal change pattern of the fundamental frequency from the voice synthesis rule section based on the analyzed information from the storage section.

2. The audio output unit according to claim 1, wherein the voice synthesis rule section further includes:

a speech rate extracting section for detecting a speech rate of the output voice;

a syntactic information extracting section for detecting syntactic information relating to the output voice;

an articulation number extracting section for detecting a number of articulations, wherein the number of articulations is used in calculating the phrase component; and a positional information extracting section for detecting positional information of a phrase command in an output sentence, wherein the phrase component is calculated in accordance with the speech rate, the syntactic information, the number of articulations, and the positional information corresponding to the phrase command.

3. A method for outputting a composite tone by expressing a temporal change pattern of a fundamental frequency of an output voice using a sum of a phrase component corresponding to an intonation of the output voice and an accent component corresponding to a basic accent of the output voice, wherein the temporal change pattern of the fundamental frequency includes linguistic information such as basic accent, emphasis, intonation, and syntax, the phrase component is approximated by a response characteristic of a first secondary linear system to an impulsive phrase command, the accent component is approximated by a response characteristic of a second secondary linear system to a step accent command, and the temporal change pattern of the fundamental frequency is expressed on a logarithmic scale, the method comprising the steps of:

storing analyzed information including a word, a boundary between articulations, and a basic accent, wherein the analyzed information is obtained by analyzing an input character list;

changing a reduction or damping characteristic of a phrase component of a fundamental frequency in order to control a response characteristic of a first secondary linear system to a phrase command used in calculating the phrase component, the reduction or damping characteristic being any of an underdamped characteristic, a critically-damped characteristic, and an overdamped characteristic;

generating a temporal change pattern of the fundamental frequency in accordance with the calculated phrase components; and generating a composite tone using synthesized waveform data generated in accordance with predetermined phonemic rules and the temporal change pattern of the fundamental frequency based on the analyzed information.

4. The method for outputting a composite tone according to claim 3, wherein the step of generating a temporal change pattern of the fundamental frequency comprises:

detecting a speech rate of the output voice;

detecting syntactic information related to the output voice;

detecting a number of articulations, wherein the number of articulations is used in calculating the phrase component;

detecting positional informational for a phrase command in an output sentence;

controlling the reduction or damping characteristic of the phrase component in accordance with the speech rate, the syntactic information, the number of articulations, and the positional information for the phrase command, the reduction or damping characteristic being any of an underdamped characteristic, a critically-damped characteristic, and an overdamped characteristic; and calculating the phrase component.

* * * * *